US007066785B2

(12) United States Patent
Park et al.

(10) Patent No.: US 7,066,785 B2
(45) Date of Patent: Jun. 27, 2006

(54) POLISHING APPARATUS AND RELATED POLISHING METHODS

(75) Inventors: Moo-Yong Park, Gyeonggi-do (KR); Sang-Rok Hah, Seoul (KR); Jong-Gyoon Kim, Gyeonggi-do (KR); Hong-Seong Son, Gyeonggi-do (KR); Ja-Hyung Han, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 232 days.

(21) Appl. No.: 10/715,314

(22) Filed: Nov. 17, 2003

(65) Prior Publication Data

US 2004/0137829 A1 Jul. 15, 2004

(30) Foreign Application Priority Data

Jan. 10, 2003 (KR) ..... 10-2003-0001690

(51) Int. Cl.
*B24B 49/00* (2006.01)

(52) U.S. Cl. ..... 451/5; 451/285; 451/287; 451/398

(58) Field of Classification Search ..... 451/5, 451/9, 10, 11, 41, 285, 287, 288, 397, 398, 451/8

See application file for complete search history.

(56) References Cited

U.S. PATENT DOCUMENTS

| | | | | |
|---|---|---|---|---|
| 5,822,243 | A | 10/1998 | Shone | |
| 5,888,120 | A * | 3/1999 | Doran | 451/41 |
| 5,989,103 | A * | 11/1999 | Birang et al. | 451/41 |
| 6,050,882 | A * | 4/2000 | Chen | 451/41 |
| 6,183,342 | B1 * | 2/2001 | Watanabe et al. | 451/5 |
| 6,213,855 | B1 * | 4/2001 | Natalicio | 451/364 |
| 6,325,696 | B1 * | 12/2001 | Boggs et al. | 451/5 |
| 6,354,928 | B1 * | 3/2002 | Crevasse et al. | 451/397 |
| 6,436,828 | B1 * | 8/2002 | Chen et al. | 438/691 |
| 6,592,434 | B1 * | 7/2003 | Vanell et al. | 451/41 |
| 6,719,615 | B1 * | 4/2004 | Molnar | 451/41 |
| 6,899,607 | B1 * | 5/2005 | Brown | 451/288 |

FOREIGN PATENT DOCUMENTS

| | | | |
|---|---|---|---|
| JP | 62094257 | * | 4/1987 |
| JP | 8-155831 | | 6/1996 |

* cited by examiner

*Primary Examiner*—Eileen P. Morgan
(74) *Attorney, Agent, or Firm*—Myers Bigel Sibley & Sajovec PA

(57) ABSTRACT

Polishing apparatus and related methods employ aligned first and second magnetic field sources to adjust the compressive force and/or pressure applied by a carrier head against a target workpiece (such as a wafer) by selectively and controllably generating a repellant or attractive force between the two magnetic field sources.

17 Claims, 8 Drawing Sheets

POLISHING APPARATUS AND RELATED POLISHING METHODS

RELATED APPLICATION

This application claims priority to Korean Patent Application Serial No. 2003-1690, filed on Jan. 10, 2003, the contents of which are hereby incorporated by reference as if recited in full herein.

FIELD OF THE INVENTION

The present invention relates to polishing apparatus and methods of polishing, and more particularly to polishing apparatus and methods capable of reducing non-uniformity of thickness of an object to be polished. The apparatus and methods may be particularly suitable for use with wafers and/or structures comprising semiconductor substrates.

BACKGROUND OF THE INVENTION

Typically, when buried metal wiring such as Cu, Damascene, etc., is formed through planarized metal film (such as Cu, W, Al) deposited on a target substrate, such as a semiconductor substrate, CMP (Chemical Mechanical Polishing) can be used.

Also, upon simultaneous formation of the metal buried wirings whose widths may be different from each other, if metal film is deposited on a plurality of grooves whose widths are different, then unevenness (i.e., step differences) may be undesirably formed on the surface of the metal film.

In the past, in an attempt to reduce such unevenness of the metal film, CMP has generally been performed on the target workpiece by controlling the rigidity and rotational speed of a polishing pad used to polish the workpiece.

In the CMP process, a wafer can be rubbed against a rotating polishing pad (or the polishing pad rubbed against the wafer), thereby polishing target surfaces on the wafer, typically so that a variety of films may be polished. The amount of material polished away or removed can depend on the strength or magnitude of the frictional force exerted between the polishing pad and the wafer.

Japanese Patent Publication No.8-155831 entitled, Polishing Apparatus and Polishing Method, proposes to improve the uniformity of the applied frictional force. This patent describes using first and second magnetic field generating bodies for providing magnetic fields. The first magnetic field generating body is generally described as being installed inside of a wafer chuck table and the second magnetic field generating body is described as being configured to generate a repellant magnetic field with respect to the magnetic field generated from the first magnetic field generating body. The second magnetic field generating body is installed in the inside of a turntable, so that an a spacing between the lower side of the wafer chuck table and the upper side of the turntable is maintained parallel to each other due to the repellant force generated by the interaction of the magnetic field generated from the first magnetic field generating body and the magnetic field generated from the second magnetic filed generating body, whereby it is alleged that a more uniform polishing film may be formed.

It is also noted that one of the factors that can determine the strength or intensity of the frictional force applied between the wafer and the polishing pad is the pressure applied to the back of the wafer. U.S. Pat. No. 5,822,243 entitled, Method for Polishing Semiconductor Wafer Using Dynamic Control, proposes an apparatus for controlling the intensity of the pressure applied to the back of the wafer. The content of this patent is hereby incorporated by reference as if recited in full herein. Generally stated, this patent describes a carrier head having a modulation unit. The modulation unit includes a plurality of capacitors having a lower flexibly configured plate and a plurality of upper division plates. A controller monitor can compare capacitance measured between each upper division plate and a lower plate with respect to a predetermined capacitance. If the measured capacitance is different from a predetermined capacitance, the controller monitor can set a voltage operational parameter to a predetermined voltage by controlling an appropriate voltage for each upper division plate. Therefore, the wafer polishing process may be performed dynamically with local adjustability.

In the past, the size of the area where force was applied to the back of the wafer has sometimes been controlled by a pressure change of $N_2$ gas or air. For example, FIG. 1 shows an exemplary configuration of a system used to control pressure by controlling the area over which the force is applied to the back of a wafer 9. As shown in FIG. 1, a rotating turntable 3 includes a polishing pad 1 held on its upper surface. The system also includes a carrier head 10 configured to maintain the spatial alignment or position of the wafer W (shown as object 9) to be polished with respect to the carrier head 10 and/or rotating turntable 3 and polishing pad 1. The system also includes a polishing liquid supplying nozzle 7 for supplying polishing liquid S to the polishing pad 1. As shown in FIG. 1, the carrier head 10 is connected to a shaft 11.

The carrier head 10 has a guide ring 13 of a closed, typically disk, shape that is held at the carrier head's 10 outer peripheral edge so as to trap the object 9 to be polished (the "object" may be referred to for ease of description below as the "wafer"). The guide ring 13 is affixed to the carrier head with its lower surface extending or projecting downward to reside a distance below the lower surface of the carrier head 10. The lower surface of the carrier head 10 can define a maintenance surface. If the wafer 9 detaches from the lower surface of the carrier head 10 during the polishing process, the wafer 9 can be trapped within the guide ring 13 and inside the outer bounds of the carrier head maintenance surface by the guide ring 13 in a first direction (shown as a lateral). At the same time, the wafer 9 is compressed between the carrier head 10 and the polishing pad 1 in a second direction (shown as a longitudinal direction) due to the frictional force applied against the polishing pad 1 during polishing process to inhibit the wafer 9 from moving in the out of operational alignment in the second direction.

As shown in FIG. 2 and FIG. 3, the carrier head 10 can be configured with an air distribution plenum 15 having a plurality of air passages 19*a*, 19*b*, 19*c* extending from an air supply source in fluid communication with the plenum 15 (typically via the shaft 11) to a predetermined respective one of the segment spaces 15*a*, 15*b*, 15*c*. The spaces 15*a*, 15*b*, 15*c* are shown as being in fluid isolation from each other, with lower portions thereof spatially aligned and disposed proximate the lower surface of the carrier head 10. The air passages 19*a*, 19*b*, 19*c* are configured to supply air to a respective predetermined space 15*a*, 15*b*, 15*c*. The air distribution plenum 15 may be configured with the air spaces 15*a*, 15*b*, 15*c* being radially spaced as nested concentric rings defining respective spaces 15*a*, 15*b*, 15*c*, as shown in FIG. 3.

Each divided air distribution plenum space 15*a*, 15*b*, 15*c* has a plurality of air supply members 16*a*, 16*b*, 16*c* that, in operation, direct air into the respective plenum space. The air supply passages 19*a*, 19*b*, 19*c* can comprise tubes that engage the respective air supplying member 16*a*, 16*b*, 16*c* by means of respective connector tubes 17*a*, 17*b*, 17*c*, so that air can be selectively supplied, in serial order, from an air supply source (not shown) to one or more of the air plenum passages 19*a*, 19*b*, 19*c*, to the respective air supply members 16*a*, 16*b*, 16*c*, and then to the respective air plenum space 15*a*, 15*b*, 15*c*. In operation, the air from one or more of the air plenum spaces 15*a*, 15*b*, 15*c* can be released from the lower surface of the carrier head 10 to press the wafer 9. Therefore, the wafer 9 maintains contact force and the polishing process can be performed.

In operation, the polishing apparatus having the foregoing construction can maintain the wafer 9 on the lower surface of the carrier head 10, by applying pressure to the wafer 9 at the polishing pad 1 on the turntable 3 via the carrier head 10. At the same time, the apparatus can polish the wafer 9 by rotating the turntable 3 under the carrier head 10. During operation, as shown in FIG. 2, polishing liquid S is supplied on the polishing pad 1 from the polishing liquid supplying nozzle 7. An example of a conventional polishing liquid is a liquid made of particulates suspended in an alkaline solution. Here, the wafer 9 can be polished by the combined operation of chemical polishing due to the alkaline solution and a mechanical polishing due to the particulates. Unfortunately, the polishing apparatus having the foregoing construction may have problems that contribute to non-uniform polishing. For example, as the air supplying members 16*a*, 16*b*, 16*c* and the air supplying tubes 19*a*, 19*b*, 19*c* are connected via connecting tubes 17*a*, 17*b*, 17*c*, air leaks may be undesirably introduced through the connections potentially applying non-uniform air pressure against the wafer 9. In addition, the air supplying members 16*a*, 16*b*, 16*c* are biased to a local input zone on one side of the concentric plenum spaces 15*a*, 15*b*, 15*c*, each having a relatively small isolated inlet region that directs the air into a larger underlying plenum space. In operation, air supplied via the localized supply inlet members 16*a*, 16*b*, 16*c* is distributed within their corresponding plenum space 15*a*, 15*b*, 15*c*, along arrow directions (orthogonal and/or clockwise and counterclockwise directions, respectively) as shown in FIG. 3. A pressure difference may be generated between the side of the air supplying members 16*a*, 16*b*, 16*c* and a location in the respective plenum substantially opposing the air supplying member location, i.e., such as the portions denoted by A, B, C positioned in the air supply plenum space 15*a*, 15*b*, 15*c* at a location that is substantially opposite to the side holding the respective air supplying member 16*a*, 16*b*, 16*c*. Therefore, the wafer 9 may not be uniformly pressed.

SUMMARY OF THE INVENTION

Embodiments of the present invention provide polishing apparatus and/or polishing methods capable of maintaining substantially uniform polishing thickness of an object to be polished by generating pressure that can be substantially uniformly applied to an object (such as a wafer) to be polished.

Certain embodiments are directed to polishing apparatus that can include: (a) a rotatable turntable having a polishing pad; (b) a carrier head configured to cooperate with the polishing pad and hold a target workpiece to be polished in alignment with the polishing pad on the turntable; and a magnetic field control unit comprising a plurality of first magnetic field sources disposed inside of the carrier head for generating respective first magnetic forces, and a plurality of second magnetic field sources disposed inside the carrier head configured to generate respective second magnetic forces. A respective one of the plurality of second magnetic field sources being substantially spatially aligned with a respective one of the second magnetic field sources to define a magnetic field source pair. Each magnetic field source pair being spaced apart from the others. In operation, the second magnetic field source in each magnetic field source pair is configured to selectively repel or attract the corresponding first magnetic filed source.

In certain embodiments, the first magnetic field source comprises a permanent magnet and the second magnetic field source comprises an electromagnet. The first magnetic field source can be installed in a lower side of the carrier head and the second magnetic field source installed above the first magnetic field source in an intermediate or upper portion of the carrier head. In other embodiments, the second magnetic field source can be installed lower in the carrier head and the first magnetic field source positioned thereabove.

In particular embodiments, the first magnetic field source includes a plurality of concentrically arranged and/or aligned permanent magnets including a center permanent magnet; an intermediate permanent magnet surrounding an outer peripheral edge of the center permanent magnet; and an outer permanent magnet surrounding an outer peripheral edge of the intermediate permanent magnet. Similarly, the second magnetic field source can include a plurality of concentrically arranged and/or aligned electromagnets including: a center electromagnet; an intermediate electromagnet arranged to surround an outer peripheral edge of the center electromagnet; and an outer electromagnet arranged to surround an outer peripheral edge of the intermediate electromagnet.

In certain embodiments, an insulating material, film and/or coating can be intervened between the magnet pairs to inhibit magnetic interference (and may substantially magnetically isolate) adjacent magnet pairs from each other.

In certain embodiments, the system can also include a polishing film thickness detector for detecting thickness of a polishing film of an object to be polished, and a magnetic force adjustment unit for controlling polarity and/or strength of the magnetic force of the second magnetic field source responsive to the dynamically detected thickness of a polishing film provided by the polishing film thickness detector.

Other embodiments are directed toward methods for polishing a target workpiece using a carrier head housing a first magnetic field source and a second aligned magnetic field source. The methods include: generating a repellant or an attractant magnetic force between the first and second magnetic field sources; rotating a turntable that is cooperably aligned with the carrier head with an object to be polished positioned therebetween, in a predetermined direction, with the carrier head configured to apply pressure against the object in a direction toward the turntable; and controlling the pressure applied to the object by the carrier head using the generated repellant and/or attractant magnetic forces.

Certain embodiments are directed toward carrier head assemblies for a polishing system. The carrier head assemblies are adapted to engage a target workpiece to expose a target surface thereof for polishing. The assemblies include: (a) a carrier head body; (b) a plurality of permanent magnets held in the carrier head body, the permanent magnets configured to generate respective magnetic forces; and (c) a plurality of electromagnets held in the carrier head body, the electromagnets configured to generate respective magnetic forces. Each electromagnet is configured and positioned in the carrier head body so that, in operation, a respective electromagnet magnetic force repels or attracts the magnetic force generated by at least one of the permanent magnets whereby the carrier head is configured to generate adjustable magnetic forces that exert pressure on a surface of a target workpiece.

Other embodiments are directed toward polishing systems for polishing a coating, film or other target surface material on a semiconductor substrate. The systems include: (a) means for applying a plurality of spatially separate magnetic forces arranged to cover greater than a major portion of a rear surface area of a semiconductor substrate to force the semiconductor substrate toward a polishing device; and (b) means for individually dynamically adjusting the strength of the applied magnetic forces.

In particular embodiments, the system may also include a plurality of polishing film thickness sensors configured to measure a film thickness on a polishing surface of the semiconductor substrate, and means for automatically relaying the measured thicknesses to the means for adjusting the strength of the applied magnetic forces. In addition, the means for applying magnetic forces can comprise a plurality of electromagnets in communication with respective permanent magnets. The means for dynamically adjusting can include increasing current transmitted to a selected electromagnet to increase the applied magnetic force and/or decreasing current transmitted to a selected electromagnet to decrease the applied magnetic force. Similarly, the means for adjusting may include a means for altering the polarity of the electromagnet to repel or attract a corresponding permanent magnet to thereby increase or decrease the applied magnetic force.

Still other embodiments are directed toward methods of applying pressure to a target workpiece undergoing polishing using a carrier head. The methods include: (a) generating a plurality of individually adjustable magnetic forces at a plurality of spaced apart locations across a lower surface of a carrier head; and (b) pressing against a rear surface of a target workpiece with the plurality of separately generated magnetic forces.

In particular embodiments, the methods may also include dynamically selectively adjusting each or selected ones the magnetic forces based on substantially real-time feedback of a polishing thickness measured at a plurality of different locations on the polishing surface of the target workpiece.

Yet other embodiments are directed to computer program products for controlling pressure applied by a carrier head to a rear surface of a workpiece with a target front surface being polished. The computer products include a computer readable medium having computer readable program code embodied therein. The computer readable program code includes computer readable program code configured to individually selectively control current input to each of a plurality of different electromagnets held in a carrier head to adjust a magnetic force applied to the workpiece by the carrier head.

In particular embodiments, the computer program product can include computer readable program code configured to selectively control the polarity of a magnetic field and/or the field strength generated by each of a plurality of different electromagnets held in a carrier head.

DETAILED DESCRIPTION

The present invention will now be described more fully hereinafter with reference to the accompanying drawings, in which embodiments of the invention are shown. Like numbers refer to like elements. In the figures, certain features, layers or components may be exaggerated for clarity. Also, in the figures, broken lines indicate optional features or components unless stated otherwise. When a layer is referred to as being "on" another layer or substrate, it can be directly on the other layer or substrate, or intervening layers, films, coatings and the like may also be present unless the word "directly" is used which indicates that the feature or layer directly contacts the feature or layer. In addition, spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

An exemplary embodiment of the present invention will now be described with reference to FIGS. 4 through 7.

Figure 1:
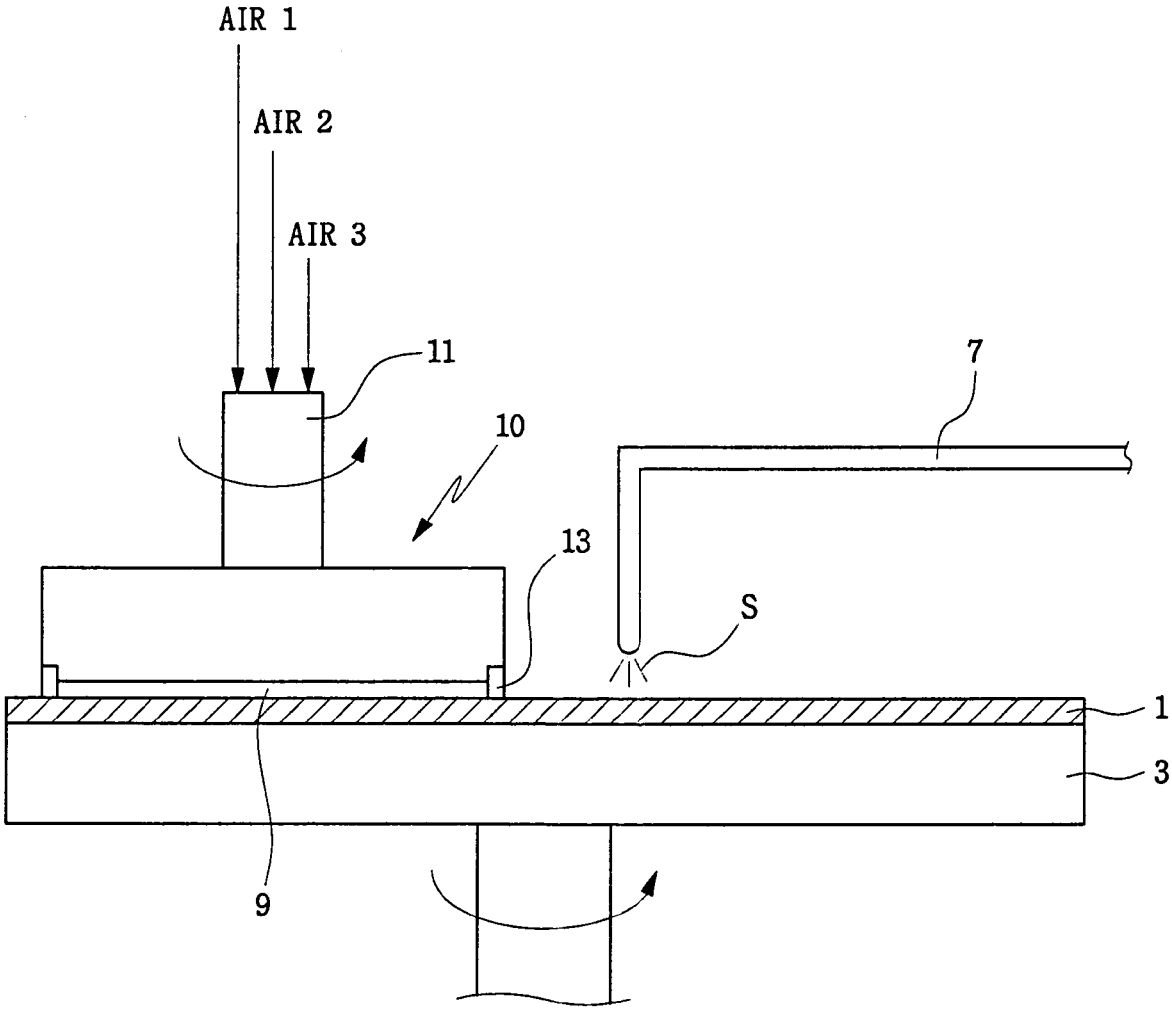
FIG. 1 (PRIOR ART)
FIG. 1 is a schematic drawing illustrating a known prior art CMP apparatus having a carrier head and rotatable turntable.
Figure 2:
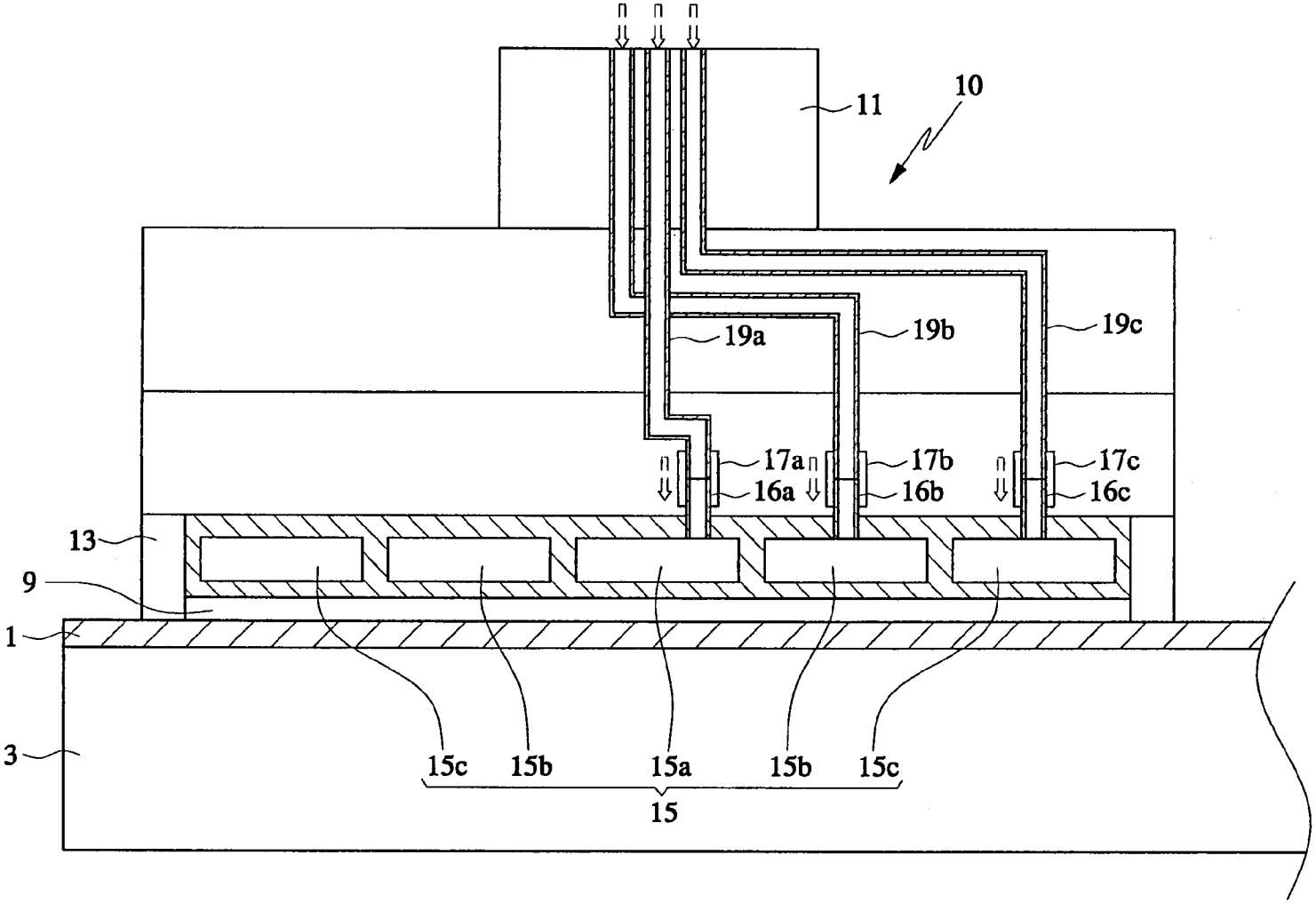
FIG. 2 (PRIOR ART)
FIG. 2 is cross-sectional side view of a prior art pressure distribution plenum system with air passages connecting to air plenum spaces in the carrier head of the apparatus shown in FIG. 1.
Figure 3:
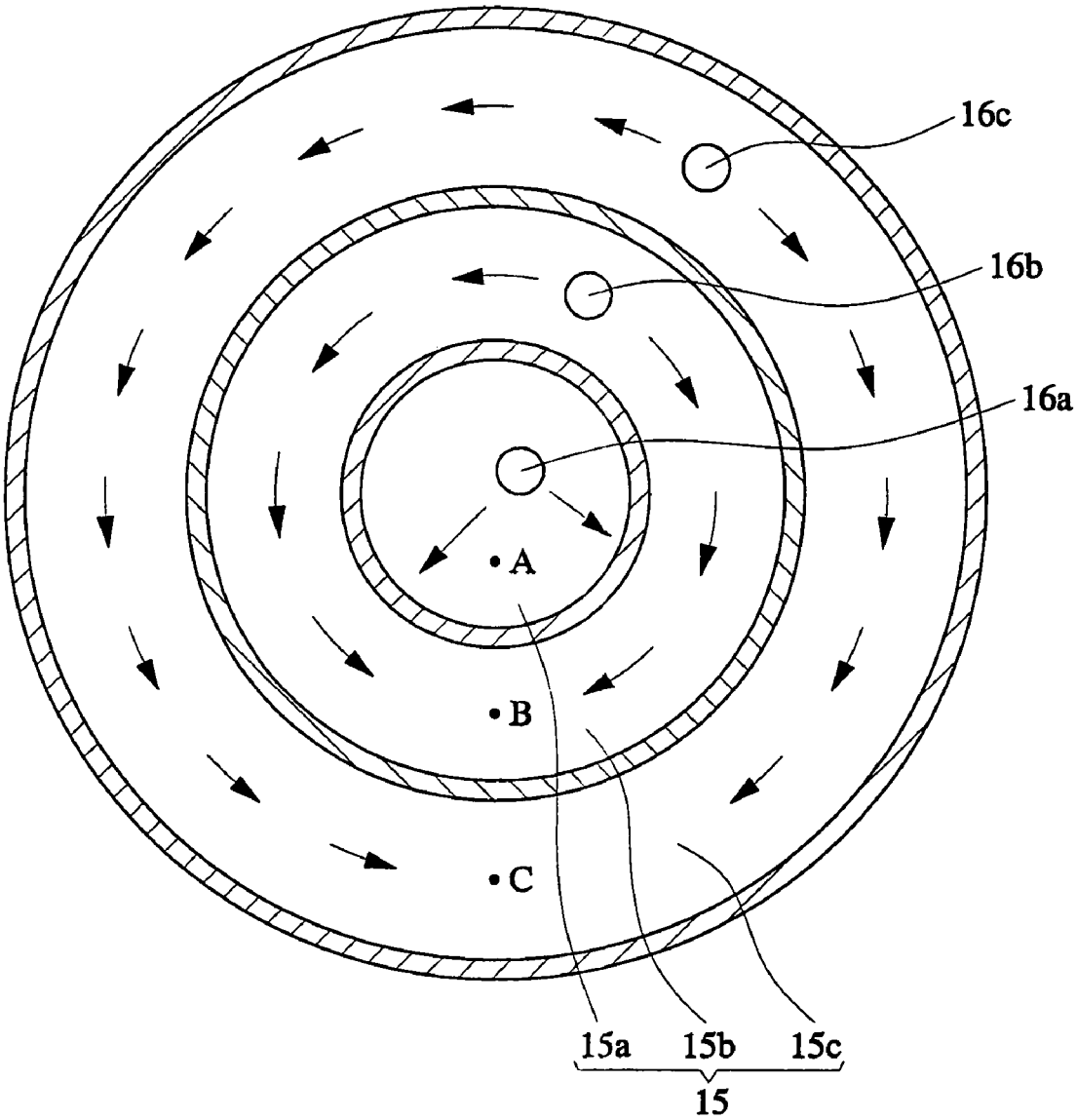
FIG. 3 (PRIOR ART)
FIG. 3, cross-sectional top view of the pressure distribution plenum spaces in the carrier head shown in FIG. 2.
Figure 4:
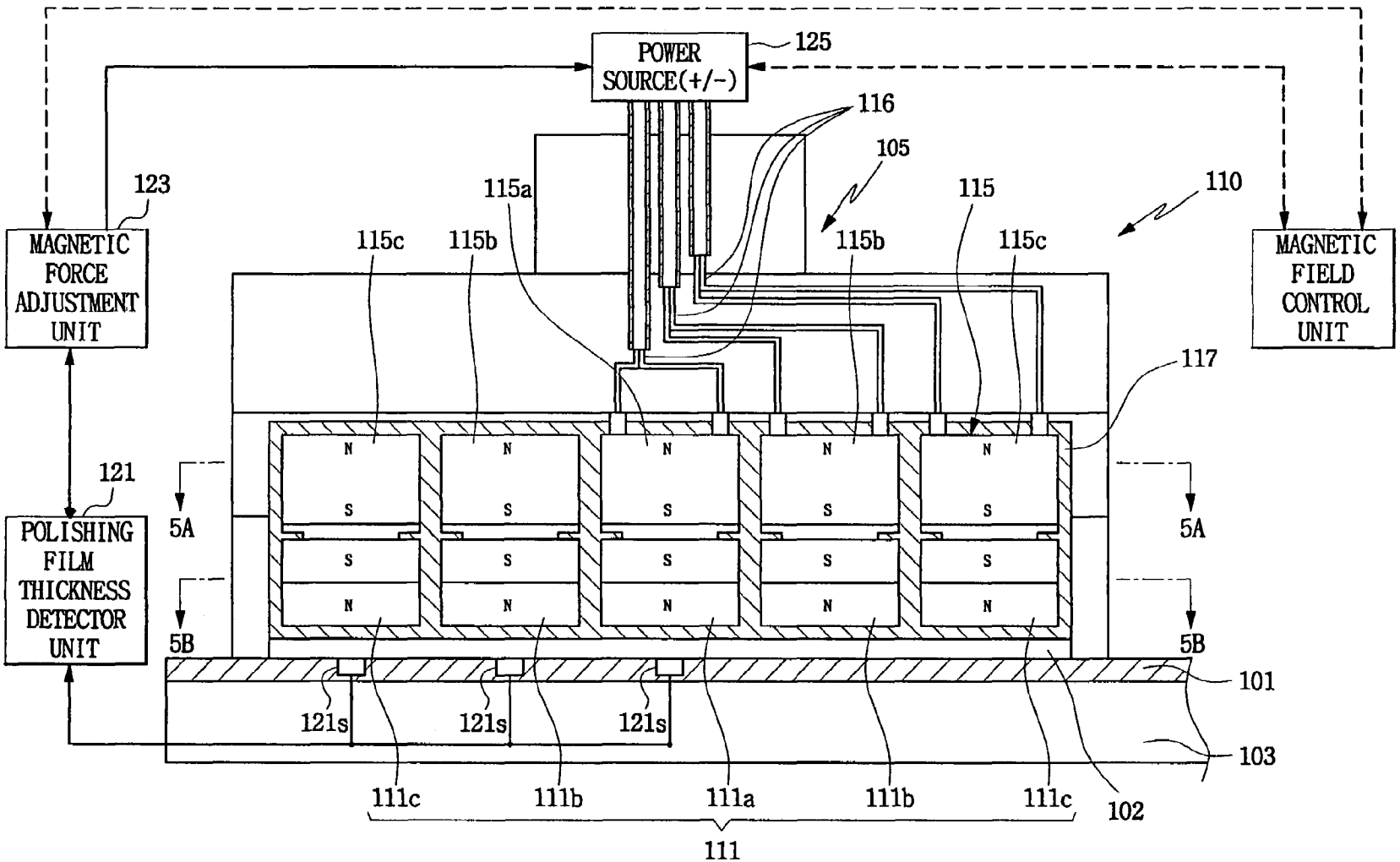
FIG. 4 is a schematic front view illustration of a polishing apparatus comprising a carrier head according to embodiments of the present invention.

As shown in FIG. 4, the apparatus includes a rotating turntable 103 having a polishing pad 101 disposed on its upper surface, and a carrier head 105 for holding the target workpiece or object 102 in position relative to the underlying turntable 103 so that the workpiece object rotates responsive to the rotation of the turntable and is pressed and/or forced down away from the carrier head 105 toward the polishing pad 101. The target workpiece 102 can be, for example, a semiconductor wafer.

As also shown in FIG. 4, the carrier head 105 houses first and second magnetic field sources, 111, 115, respectively. The carrier head 105 is in communication with a magnetic field control unit 110 that controls the magnetic field strength applied by the carrier head 105 via the first and second magnetic field sources, 111, 115. In operation, the magnetic field control unit 110 is configured to control the polarity (e.g., direction and/or intensity) of magnetic field(s) generated or output by the carrier head 105 to thereby control the force and/or pressure applied by the carrier head 105 to the underlying target workpiece 102 as the target workpiece 102 is held against the polishing pad 101. The magnetic field control unit 110 can adjust the magnetic field strength by adjusting a repellant or attractive magnetic force applied by the second magnetic field source 115 that affects the magnetic field generated by the first magnetic field source 111. The system can be configured to automatically adjust the back-pressure at a localized area, dynamically during the polishing. In particular embodiments, the dynamic adjustment of magnetic fields can be carried out in substantially real-time using measurements taken on the polishing surface.

The first magnetic field source 111 is configured to generate a first magnetic field and the second magnetic field source 115 is spaced apart from and spatially aligned with the first magnetic field source and is configured to generate a second magnetic field 111, so as to be able to controllably adjust and/or alter the strength of the first magnetic field by generating selective different attractive and/or repellant magnetic force(s) onto the first magnetic field source 111.

In certain embodiments, the first magnetic field source 111 comprises at least one permanent magnet, and the second magnetic field source 115 comprises at least one electromagnet. In particular embodiments, the second field source electromagnet 115 can be controlled to generate a magnetic field polarity by positioning and controlling the direction of the current introduced to the electromagnet. The field polarity can be selectively output to be either the same as or opposite that provided by the first magnetic field source to thereby attract and/or repel the first magnetic field source and adjust the magnetic field applied to the target workpiece 102 by the carrier head 105. In addition, or alternatively, the intensity or field strength of the magnetic field provided by the electromagnet can be controlled by controlling the amount of current in the electromagnet (lesser current for a smaller field strength). The electromagnet can be oriented in the carrier head 105 so that it is able to generate a magnetic field having a direction that it is selectively cumulative to or reduces that provided by the underlying first magnetic field source 111.

As shown in FIG. 4, the first magnetic field source 111 is installed in a lower portion of the carrier head 105 and the second magnetic field source 115 is arranged above the first magnetic field source 111 on an upper portion of the carrier head 105. However, in other embodiments, the second magnetic field source 115 can be installed in the lower portion of the carrier head 105 and the first magnetic field source 111 disposed in the upper portion above the second magnetic field source 115.

In particular embodiments, such as where the second magnetic field source 115 is configured as an electromagnet, a power source connecting line 116 (through which current is supplied), connects the second magnetic field source 115 and it may be easier to route the line 116 to the second magnetic field source 115 when the second magnetic field source 115 is arranged in the upper portion of the carrier head 105 above the first magnetic field generating body 111. Further, although shown as a single power source 125 (that can be configured to selectively power or adjust current intensity/direction in each electromagnet), each electromagnet may have its own power source.

In certain embodiments, the first magnetic field source 111 is configured as a plurality of discrete permanent magnets that are substantially concentrically arranged with respect to each other. The plurality of discrete permanent magnets can include: a center permanent magnet 111*a* which may have a substantially cylindrical shape with a circular shape when viewed from the top or bottom; an intermediate or middle permanent magnet 111*b* having an annular or ring shape with an open center with the inner perimeter thereof positioned adjacent the outer perimeter of the center permanent magnet 111*a;* and an outer permanent magnet 111*c*, also having an annular or ring shape positioned adjacent to and surrounding the intermediate permanent magnet 111*b*. Each or selected ones of the center, intermediate and/or outer permanent magnets 111*a*, 111*b*, 111*c*, can be a single permanent magnet sized and configured to provide the desired magnetic field or a plurality of permanent magnets that are stacked or otherwise configured to cooperate in the carrier head 105 to provide the desired field strength and polarity.

Similarly, in certain embodiments, the second magnetic field source 115 can include a plurality of individually adjustable and discrete electromagnets that are spatially concentrically arranged with respect to each other. The plurality of electromagnets can include: a center electromagnet 115*a* having a circular cross-sectional perimeter, with a size and shape that substantially corresponds to that of the center permanent magnet 111; an intermediate electromagnet 115*b* surrounding the outer perimeter or outer peripheral edge of the center electromagnet 115*a*, with an outer perimeter size that substantially corresponds to that of the intermediate permanent magnet configuration 111*b;* and an outer electromagnet 115*c* positioned adjacent the outer perimeter of the intermediate magnet 115*b* to encase both the center and intermediate electromagnets 115*a*, 115*b*. The outer electromagnet 115*c* can have an outer perimeter size and shape that substantially corresponds to that of the outer perimeter of the outer permanent magnet 111*c*.

An insulating material, coating and/or film 117 can be positioned on selected or all longitudinally extending surfaces to substantially isolate each corresponding pair of first and second magnetic field sources (i.e., the center pair 111*a*, 115*a*, the intermediate pair 111*b*, 115*b* and the outer pair 111*c*, 115*c*) from the polarities of the other pairs of first and second magnetic field sources. For example, an insulating material, film and/or coating 117 can be applied to the sidewall(s) of the cavity (and/or the cavity formed with a field insulating material) holding the permanent magnet and electromagnet pairs such as the cavity holding the center permanent magnet 111*a* and the corresponding electromagnet 115*a*, in the carrier head 105. Alternatively, the insulating material, film, and/or coating 117 can be applied to a substrate body holding electrical wire or windings forming the electromagnet thereon or therein. As yet another exemplary alternative, the coating or film may be applied to the outer longitudinal surfaces of the permanent magnets and the outer surfaces of the aligned corresponding electromagnets. Other portions of the carrier head 105 may also be configured with the insulating material 117 to provide the desired electrical separation between other operational components that may be undesirably affected by magnetic fields. Other arrangements of the insulating material, film and/or coating 117 may also be used to provide the desired isolation between the magnet pairs.

In particular embodiments, the insulating material, film and/or coating 117 is an insulating film 117 that is interleaved between center, intermediate, and outer magnets 111*a*, 111*b*, 111*c* and the center, middle, outer electromagnets 115*a*, 115*b*, 115*c* so that any field influence (strength, polarity, etc.) between magnet pairs is inhibited and/or so that a field polarity and strength generated by a respective magnet pair is not unduly influenced by and/or may be isolated from those of the other and/or adjacent magnet pairs.

Figure 6:
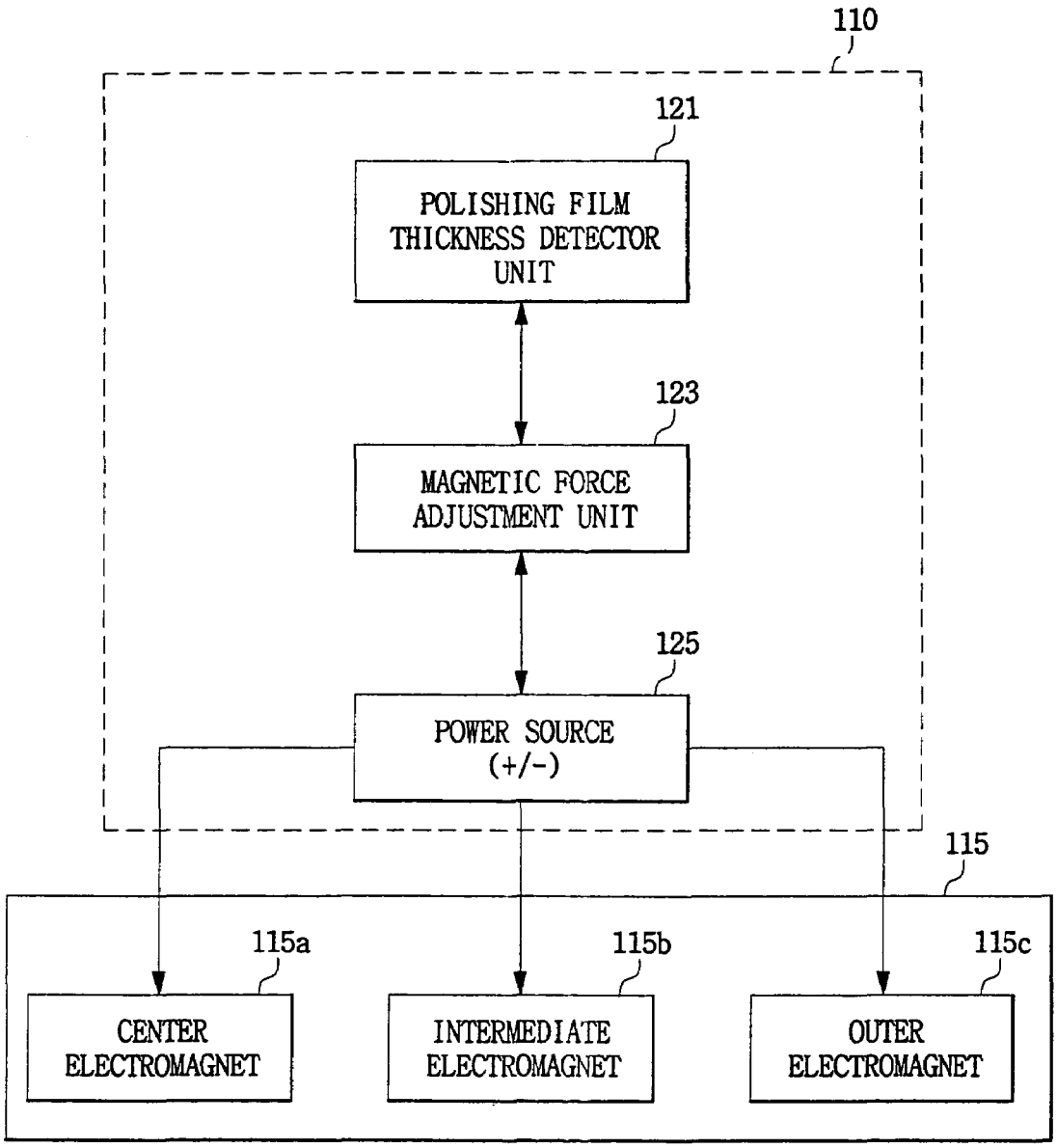
FIG. 6 is a block diagram of components of an exemplary CMP apparatus according to embodiments of the present invention.

Also, as shown in FIG. 4 and FIG. 6, the system can include a polishing film thickness detector unit 121 for detecting a thickness of a polishing film of the target workpiece 102, and a magnetic force adjustment unit 123 for controlling either and/or both the intensity and polarity of each of the center, intermediate, and outer electromagnets 115*a*, 115*b*, 115*c*, respectively, responsive to the detected thickness of the polished film provided by the film thickness detector unit 121. Although shown as a separate module in FIG. 4, the magnetic force adjustment unit 123 may form a part of and reside in a control module with a processor forming a portion of the magnetic field application control unit 110 (FIG. 6) which receives feedback and dynamically controls the operation of the system. In other embodiments, the magnetic force adjustment unit 123 may be a separate module and communicate with a processor in magnetic field control unit 110, as suitable to provide the desired controllable output. In still other embodiments, the magnetic field control unit 110 may include the magnet hardware and electronic switches or electromagnet components and can operate based on instructions directly from the magnetic force adjustment unit 123.

Similarly, the polishing film detector unit 121 may be a separate module or unit or be integrated into the magnetic force adjustment unit 123 and/or magnetic field control unit 110. As shown by the broken line box in FIG. 6, the magnetic field control unit 110 can include both a magnetic force adjustment unit 123 and the polish film thickness detector unit 121.

In operation, a polishing film thickness can be detected at a plurality of different locations across the target polishing surface of the target workpiece 102. Typically, at least one thickness sensor 121*s* is positioned in the upper surface of the polishing pad 101 aligned with and underlying each of the three lower magnets 111*a*, 111*b*, 111*c*, so as to be able to contact the polishing surface of the target workpiece 102. The thickness at monitored each location can be detected at desired intervals, typically at least intermittently, and in certain embodiments, substantially continuously, during the polishing process and compared to a predetermined reference standard or a desired end thickness. The magnetic force adjustment unit 123 can compare the detected thickness at each region with the reference or desired thickness and automatically adjust the magnetic force (current intensity and/or polarity of one or all of the electromagnets) in response thereto.

Polarities of the center, intermediate, and outer electromagnets 115*a*, 115*b*, 115*c* are controlled by the direction of current provided from a power source 125, and the intensity of magnetic force generated by a respective electromagnet is controlled through the amount of current provided thereto from the power source 125. Other current or electronic components may also be used to control drift based on temperature or other operational parameters as desired.

Figure 5A:
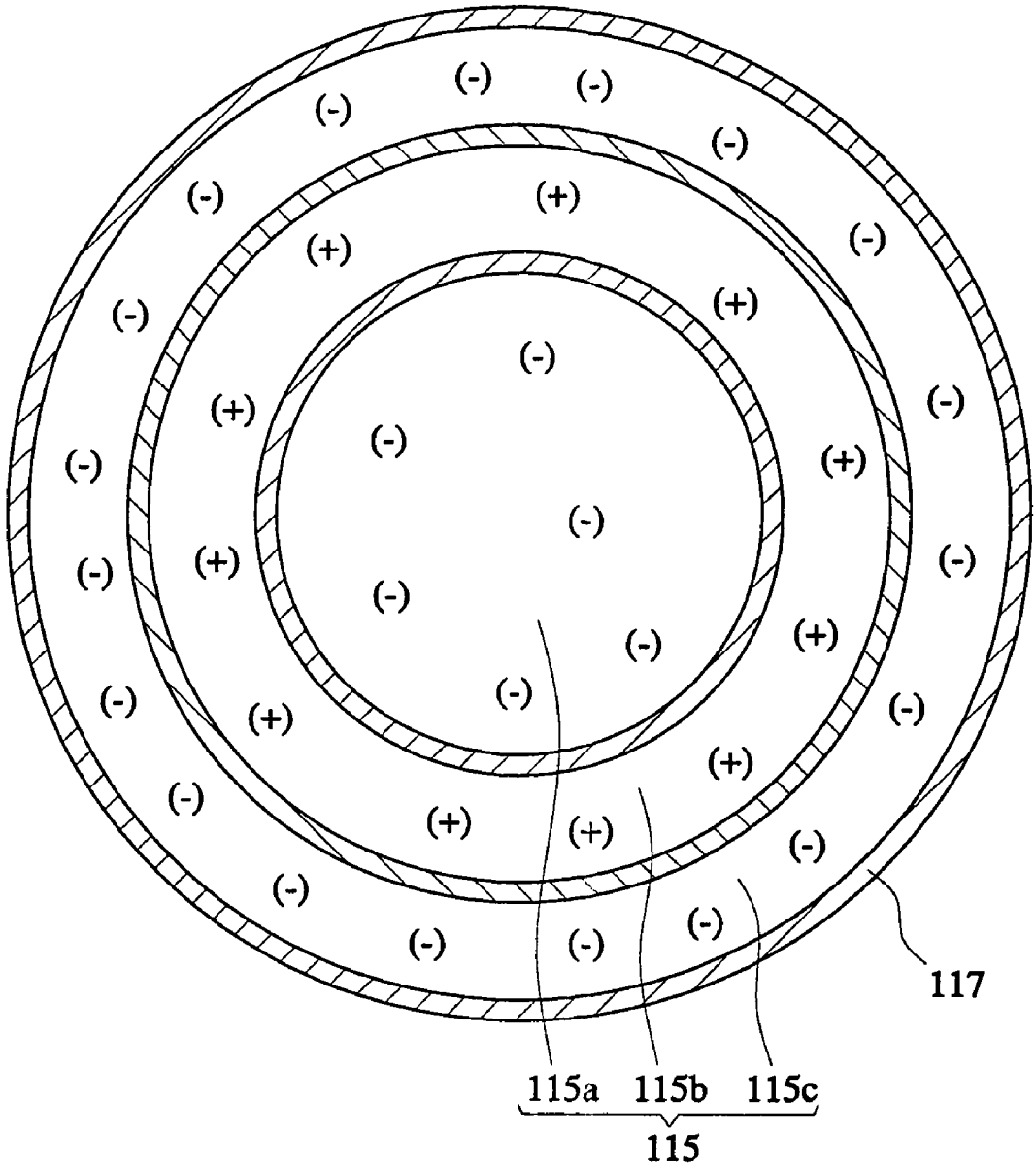
FIG. 5A is a cross-sectional top view, taken along line 5A—5A in FIG. 4.
Figure 5B:
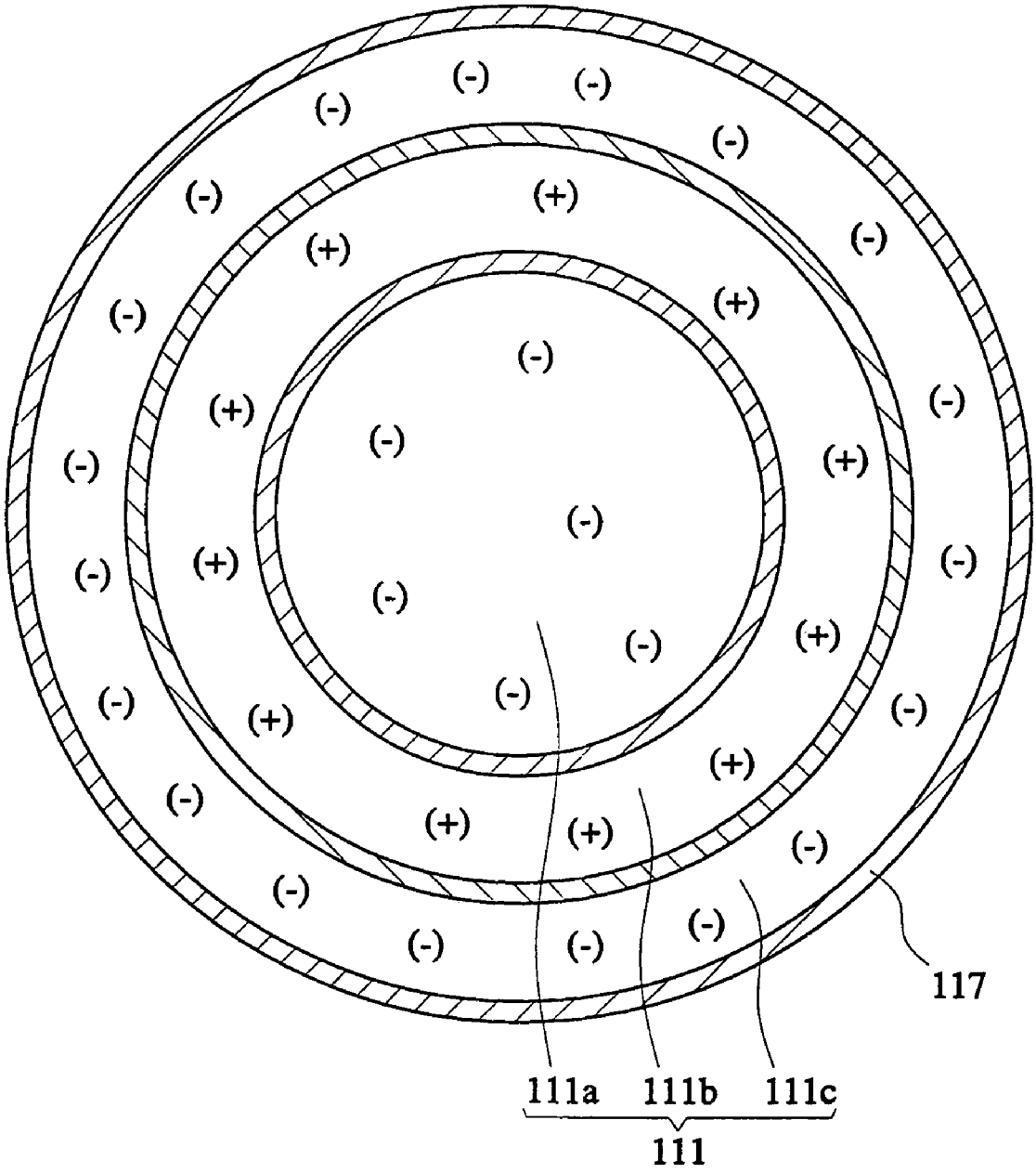
FIG. 5B is a cross-sectional top view, taken along line 5B—5B in FIG. 4.

FIG. 5A illustrates a section view taken along a portion of the carrier head 105 with an example of field polarities generated by respective second magnetic field sources 115, (i.e., electromagnets 115*a*, 115*b*, 115*c*) that are housed above the first magnetic field sources 111 (i.e., permanent electromagnets 111). As shown in FIG. 4, each permanent magnet may have the same magnetic pole orientation. As shown in FIG. 5A, the outer and center electromagnets 115*c*, 115*a*, respectively, can have the same polarity (shown as a (−) which can represent a S-N pole orientation), and the intermediate electromagnet 115*b* can have a different polarity (shown as (+) which can represent a N-S pole orientation of an axially generated magnetic field). FIG. 5B illustrates that the (lower) permanent magnets 111*a*, 111*b*, 111*c*, can have the same polarity as the respective corresponding electromagnet in the magnet field pair, i.e., respectively 111*a* can have the same polarity as the polarity of magnet 115*a*, and so on. One or more of the electromagnets may be controlled to change their polarity during the polishing process.

It is noted that the polarities drawn in FIGS. 4, 5A and 5B are by way of example and for discussion purposes only. Selected ones and/or all of the discrete permanent and/or electromagnets can have different polarities from those shown in the figures as desired to create the overall combined adjustable net force exerted on the underlying workpiece 102. Further, the polarities drawn in FIGS. 5A and 5B and do not correspond to those shown in FIG. 4 and the polarities between corresponding pairs of aligned first and second magnet sources 111*a*, 115*a* or 111*b*, 115*b* or 111*c*, 115*c* may vary from that shown. The electromagnet sources may be configured to generate greater magnetic field strengths than the permanent magnets or the permanent magnets may be configured to generate greater magnetic field strengths than their corresponding electromagnet. However configured, the electromagnets can be used to generate an adjustable variable net magnetic field strength. The electromagnets may be similarly volumetrically sized (in width, depth and length) as the corresponding permanent magnets (to occupy relatively the same amount of space in the carrier head 105) or may be larger or smaller. The electromagnet and permanent magnet pairs may be sized and configured and held in the carrier head 105 so as to generate substantially axially aligned first and second magnetic fields.

In operation, the target workpiece or object 102 to be polished can be positioned on the lower surface of the carrier head 105 by means of an adhesive or other suitable engagement means (friction, bracket, guide ring, etc. . . . ) (not shown). The upper surface of the polishing pad 101 can be configured to contact the exposed surface of the target workpiece 102 (the primary surface oriented away from the carrier head body). The intensity and direction of current provided to each of the center, intermediate, and outer electromagnets 115*a*, 115*b*, 115*c*, respectively, from the power source 125, is controlled via the magnetic field application control unit 110 and/or magnetic force adjusting unit 123, so that a desired polarity and force is generated. The control unit 110 can cooperate with the magnetic force controlling unit 123 based on an in situ measured thickness (es) and/or operate with preset values to at least initiate the process based on known process variables such as, but not limited to, the size of the target workpiece 102, the material of the workpiece 102, the material of the polishing pad 101, the CMP solution, the rotation speed of the table 103, the compression force applied to the workpiece 102, the desired polished film thickness and the like. The second field source 115 with individually adjustable electromagnets 115*a*, 15*b*, 115*c*, can thus be directed generate a desired attracting force or repellant force to alter the applied force at that location in cooperation with the first magnetic field source with its corresponding center, intermediate, and outer permanent magnets 111*a*, 111*b*, 111*c*, respectively. Also, by controlling the degree, intensity, and/or strength of the electromagnetically generated magnetic field force(s), the object 102 can be pressed against the polishing pad 101 with a desired pressure. Pressure sensors can also be used to provide the desired feedback to control the applied pressure (not shown).

In any event, the carrier head 105 and the turntable 103 are rotated so that the polishing process is performed, and at least one polishing film thickness of the workpiece/object 102 is detected by the polishing film thickness detecting unit 121 and sensor(s) 121*s*.

The detected polishing film thickness is relayed to the magnetic force adjustment unit 123 and, when the detected thickness is outside a desired (typically predetermined error range), the magnetic force adjustment unit 123, adjusts one or more of the polarities and intensities of the center, intermediate, and outer electromagnets 115*a*, 115*b*, 115*c*, respectively, to controllably adjust the pressure applied to the workpiece/object 102.

As will be appreciated by one of skill in the art, the present invention may be embodied as a method, data processing system, or computer program product. Accordingly, aspects of the present invention may take the form of an entirely hardware embodiment, an entirely software embodiment or an embodiment combining software and hardware aspects all generally referred to herein as a "circuit" or "module." Furthermore, certain features of the present invention may take the form of a computer program product on a computer-usable storage medium having computer-usable program code embodied in the medium. Any suitable computer readable medium may be utilized including hard disks, CD-ROMs, optical storage devices, a transmission media such as those supporting the Internet or an intranet, or magnetic storage devices.

Computer program code for carrying out operations of the present invention may be written in an object oriented programming language such as Java®, Smalltalk or C++. However, the computer program code for carrying out operations of the present invention may also be written in conventional procedural programming languages, such as the "C" programming language. The program code may execute entirely on the user's computer, partly on the user's computer, as a stand-alone software package, partly on the user's computer and partly on a remote computer or entirely on the remote computer. In the latter scenario, the remote computer may be connected to the user's computer through a local area network (LAN) or a wide area network (WAN), or the connection may be made to an external computer (for example, through the Internet using an Internet Service Provider).

The present invention is described in part above with reference to block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

Figure 7:
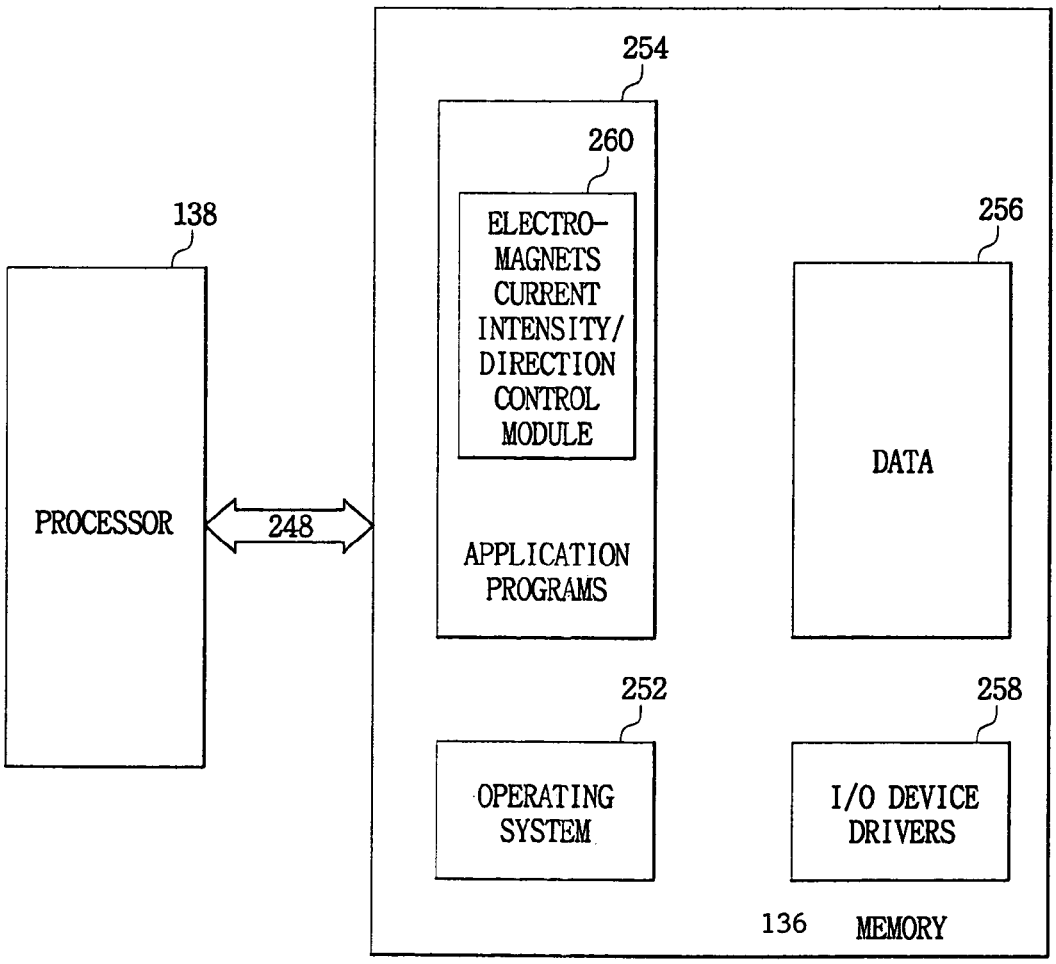
FIG. 7 is a block diagram of aspects of a data processing system that may be used in embodiments of the present invention.

FIG. 7 is a block diagram of data processing systems that illustrates systems, methods, and/or computer program products in accordance with embodiments of the present invention. As shown, the processor 138 communicates with the memory 136 via an address/data bus 248. The processor 138 can be any commercially available or custom processor circuit (such as a microprocessor or microcontroller). The memory 136 is representative of the overall hierarchy of memory devices, and may contain the software and data used to implement the functionality of the data processing system 130. The memory 136 can include, but is not limited to, the following types of devices: cache, ROM, PROM, EPROM, EEPROM, flash memory, SRAM, and DRAM.

As shown in FIG. 7, the memory 136 may include several categories of software and data used in the data processing system 130: the operating system 252; the application programs 254; the input/output (I/O) device drivers 258; and the data 256, which may include data sets defining measured polishing layer thickness and/or current and direction used to generate and adjust the applied magnetic field forces. As will be appreciated by those of skill in the art, the operating system 252 may be any operating system suitable for use with a data processing system, such as OS/2, AIX or System390 from International Business Machines Corporation, Armonk, N.Y., Windows95, Windows98, Windows2000 or WindowsXP from Microsoft Corporation, Redmond, Wash., Unix or Linux. The I/O device drivers 258 typically include software routines accessed through the operating system 252 by the application programs 254 to communicate with devices such as the I/O data port(s) 146 and certain memory 136 components. The application programs 254 are illustrative of the programs that implement the various features of the data processing system 130 and preferably include at least one application which supports operations according to embodiments of the present invention. Finally, the data 256 represents the static and dynamic data used by the application programs 254, the operating system 252, the I/O device drivers 258, and other software programs that may reside in the memory 136.

As is further seen in FIG. 7, the application programs 254 may include Electromagnets Current Intensity and/or Direction (field polarity) Control Module 260. The Electromagnets Module 260 may carry out operations described herein by selectively adjusting each electromagnet to control the applied field. While the present invention is illustrated, for example, with reference to the Electromagnets Module 260 being an application program in FIG. 7, as will be appreciated by those of skill in the art, other configurations may also be utilized while still benefiting from the teachings of the present invention. For example, the Electromagnets Module 260 may also be incorporated into the operating system 252, the I/O device drivers 258 or other such logical division of the data processing system 130. Thus, the present invention should not be construed as limited to the configuration of FIG. 7 but is intended to encompass any configuration capable of carrying out the operations described herein.

As is apparent from the foregoing, the present invention may improve the uniformity of a polishing film by applying pressure uniformly distributed over the target surface of the target workpiece/object to be polished by dynamically controlling the pressure applied by the carrier head using the magnetic field control and/or adjustment unit, and/or related devices, operations and methods.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, where used, means-plus-function clauses are intended to cover the structures described herein as performing the recited function and not only structural equivalents but also equivalent structures.

What is claimed is:

1. A polishing apparatus comprising:

a rotatable turntable having a polishing pad;

a carrier head configured to cooperate with the polishing pad to hold a target workpiece to be polished in alignment with the polishing pad on the turntable; and a magnetic field control unit comprising a plurality of spaced apart first magnetic field sources disposed inside the carrier head, for generating respective first magnetic forces, and a plurality of second magnetic field sources disposed inside the carrier head configured to generate respective second magnetic forces with each second magnetic field source comprising an electromagnet, a respective one of the plurality of second magnetic field sources being substantially spatially aligned with a respective one of the first magnetic field sources to define a magnetic field source pair, each magnetic field source pair being spaced apart from the others, wherein, in operation, the second magnetic field source in each magnetic field source pair is configured to selectively repel or attract the first magnetic field source such that, in operation, polarity of at least one of said electromagnets can reverse, and wherein, during operation, electromagnets in adjacent magnetic field source pairs have opposing polarity.

2. The apparatus according to claim 1, wherein the first magnetic field sources each comprise at least one permanent magnet.

3. The apparatus according to claim 1, wherein the first magnetic field sources are statically held lower in the carrier head than the second magnetic field sources, with the second magnetic field source for each magnetic field source pair being positioned axially aligned with and above the corresponding first magnetic field source.

4. The apparatus according to claim 1, wherein the first magnetic field sources are substantially concentrically aligned with: a center permanent magnet; an intermediate permanent magnet surrounding an outer peripheral edge of the center permanent magnet; and an outer permanent magnet surrounding an outer peripheral edge of the intermediate permanent magnet, and wherein the second magnetic field sources are substantially concentrically aligned with a center electromagnet; an intermediate electromagnet arranged to surround an outer peripheral edge of the center electromagnet; and an outer electromagnet arranged to surround an outer peripheral edge of the intermediate electromagnet.

5. The apparatus according to claim 4, wherein an insulating material, film and/or coating is positioned between adjacent magnetic field source pairs to substantially magnetically insulate the different magnetic field pairs from each other.

6. The apparatus according to claim 1, further comprising:

a polishing film thickness detector unit with a plurality of spaced apart sensors positioned proximate a polishing surface of the target workpiece for detecting a thickness of a polishing film of the target workpiece, the polishing film thickness detector unit operatively associated with the magnetic field control unit; and a magnetic force adjustment unit configured to selectively control the polarity and magnetic force generated by each of the second magnetic field sources responsive to the detected thickness of the polishing film provided by the polishing film thickness detector unit.

7. An apparatus according to claim 1, wherein there are three spaced apart magnetic field source pairs in the carrier head, a first center magnetic field source pair comprising a substantially cylindrical center permanent magnet, a second intermediate field source pair comprising an annular intermediate permanent magnet, and a third outer field source pair comprising an annular outer permanent magnet.

8. An apparatus according to claim 1, wherein the first magnetic field sources are permanent magnets, and wherein the permanent magnets are substantially static in the carrier head during operation.

9. A polishing apparatus comprising:

a rotatable turntable having a polishing pad;

a carrier head configured to cooperate with the polishing pad to hold a target workpiece to be polished in alignment with the polishing pad on the turntable; and a magnetic field control unit comprising a plurality of spaced apart first magnetic field sources disposed inside the carrier head, for generating respective first magnetic forces, and a plurality of second magnetic field sources disposed inside the carrier head configured to generate respective second magnetic forces with each second magnetic field source comprising electromagnet, a respective one of the plurality of second magnetic field sources being substantially spatially aligned with a respective one of the first magnetic field sources to define a magnetic field source pair, each magnetic field source pair being spaced apart from the others, wherein the second magnetic field sources reside lower in the carrier head than the first magnetic field sources, with the first magnetic field source for each magnetic field source pair being positioned axially aligned with and above the corresponding second magnetic field source, such that, in operation, polarity of at least one of said electromagnets can reverse, and wherein, during operation, electromagnets in adjacent magnetic field source pairs have opposing polarity.

10. A polishing apparatus comprising:

a rotatable turntable having a polishing pad;

a carrier head configured to cooperate with the polishing pad to hold a target workpiece to be polished in alignment with the polishing pad on the turntable; and a magnetic field control unit comprising three spaced apart magnet regions disposed inside the carrier head, each region holding a magnet field source pair, each magnet field source pair comprising at least one permanent magnet for generating a first magnetic force, and an aligned corresponding electromagnet configured to generate a second magnetic force, wherein, in operation, the electromagnet in at least one magnetic source pair is configured to selectively reverse polarity to controllably repel or attract the corresponding at least one permanent magnet.

11. An apparatus according to claim 10, wherein there are three magnetic field source pairs, a first center magnetic field source pair comprising a substantially cylindrical center permanent magnet, a second intermediate field source pair comprising an annular intermediate permanent magnet, and a third outer field source pair comprising an annular outer permanent magnet.

12. An apparatus according to claim 10, wherein the permanent magnets in each field source pair are substantially static during operation.

13. An apparatus according to claim 10, wherein, in operation, the electromagnet in each magnetic field source pair is configured to selectively repel or attract the first magnetic field source such that, in operation, polarity of the electromagnet can reverse.

14. An apparatus according to claim 10, wherein, during operation, electromagnets in adjacent magnetic field source pairs have opposing polarity.

15. A polishing apparatus comprising:

a rotatable turntable having a polishing pad;

a carrier head configured to cooperate with the polishing pad to hold a target workpiece to be polished in alignment with the polishing pad on the turntable; and a magnetic field control unit comprising a plurality of spaced apart first magnetic field sources disposed inside the carrier head, for generating respective first magnetic forces, and a plurality of second magnetic field sources disposed inside the carrier head configured to generate respective second magnetic forces with each second magnetic field source comprising an electromagnet, a respective one of the plurality of second magnetic field sources being substantially spatially aligned with a respective one of the first magnetic field sources to define a magnetic field source pair, each magnetic field source pair being spaced apart from the others, wherein, in operation, the second magnetic field source in each magnetic field source pair is configured to selectively reverse polarity of an electromagnet to controllably repel or attract the first magnetic field. source such that, in operation, polarity of an electromagnet can reverse.

16. An apparatus according to claim 15, wherein the are three magnetic field source pairs, a first center magnetic field source pair comprising a substantially cylindrical center permanent magnet, a second intermediate field source pair comprising an annular intermediate permanent magnet, and a third outer field source pair comprising an annular outer permanent magnet.

17. An apparatus according to claim 15, wherein the first magnetic field sources are permanent magnets, wherein the permanent magnets are substantially static in the carrier head during operation, and wherein the intermediate permanent magnet has a different polarity from the center and/or outer permanent magnet.

* * * * *

UNITED STATES PATENT AND TRADEMARK OFFICE

CERTIFICATE OF CORRECTION

PATENT NO. : 7,066,785 B2 
APPLICATION NO. : 10/715314
DATED : June 27, 2006
INVENTOR(S) : Park et al.

It is certified that error appears in the above-identified patent and that said Letters Patent is hereby corrected as shown below:

Column 14,
Line 51 should read -- second magnetic field source comprising an electromag- --

Column 15,
Line 11 should read -- tion, the electromagnet in at least one magnetic field source --

Column 16,
Line 18 should read -- controllably repel or attract the first magnetic field. --

Lines 19-20 should be deleted.

Signed and Sealed this

Twenty-eighth Day of November, 2006

JON W. DUDAS
*Director of the United States Patent and Trademark Office*